US006989176B2

(12) United States Patent
Congard et al.

(10) Patent No.: US 6,989,176 B2
(45) Date of Patent: Jan. 24, 2006

(54) DEVICE AND METHOD FOR SUPPLYING ATOMIZERS, AND SPRAYING INSTALLATION EQUIPPED WITH SUCH A DEVICE

(75) Inventors: Jean Charles Congard, Saint-Martin d'Uriage (FR); Philippe Foury, Crolles (FR); Eric Prus, Grenoble (FR)

(73) Assignee: Sames Technologies, Mevlan (FR)

( * ) Notice: Subject to any disclaimer, the term of this patent is extended or adjusted under 35 U.S.C. 154(b) by 433 days.

(21) Appl. No.: 09/982,141

(22) Filed: Oct. 19, 2001

(65) Prior Publication Data

US 2002/0046699 A1 Apr. 25, 2002

(30) Foreign Application Priority Data

Oct. 19, 2000 (FR) ..... 00 13400

(51) Int. Cl.
*B05D 1/02* (2006.01)

(52) U.S. Cl. ..... 427/427.2; 427/421.1; 427/427.3; 901/43

(58) Field of Classification Search ..... 427/421, 427/421.1, 427.2, 427.3; 901/43
See application file for complete search history.

(56) References Cited

U.S. PATENT DOCUMENTS

| | | | | |
|---|---|---|---|---|
| 4,751,994 | A * | 6/1988 | Brown et al. | 194/341 |
| 6,017,163 | A * | 1/2000 | Keppers et al. | 401/48 |
| 6,494,350 | B2 * | 12/2000 | Kelley | 222/456 |
| 6,712,285 | B2 * | 3/2004 | Provenaz et al. | 239/1 |

FOREIGN PATENT DOCUMENTS

| | | | |
|---|---|---|---|
| EP | 0 455 107 | A2 | 11/1991 |
| EP | 1027 936 | A1 | 8/2000 |
| FR | 2 777 482 | A | 10/1999 |
| WO | WO 99/52644 | A1 | 10/1999 |
| WO | 99/55465 | * | 11/1999 |

* cited by examiner

*Primary Examiner*—Katherine Bareford
(74) *Attorney, Agent, or Firm*—Browdy and Neimark, PLLC

(57) ABSTRACT

This device for supplying coating products to the atomizers of an installation for spraying coating products on objects displaced by a conveyor, comprises at least one principal tank adapted to supply secondary tanks each intended for an atomizer, and means for displacing this principal tank up to the vicinity of the secondary tanks.

6 Claims, 4 Drawing Sheets

DEVICE AND METHOD FOR SUPPLYING ATOMIZERS, AND SPRAYING INSTALLATION EQUIPPED WITH SUCH A DEVICE

FIELD OF THE INVENTION

The present invention relates to a device and a method for supplying with coating products the atomizers of an installation for spraying coating products.

BACKGROUND OF THE INVENTION

It is known to supply the atomizers of an installation for spraying coating products via product circulation conduits, also known as "circulatings", from large-capacity tanks of products, whose capacity may attain several thousands of liters. Such tanks are generally located in storage premises at a distance from the spraying installations. Taking into account the usual distance between the store and the spraying installation, the products present in the circulatings during operation are of the order of several hundreds of liters, which renders it economically impossible to change products in such circulatings, as the quantities of products lost thereby are inacceptable. It is therefore necessary to provide one circulating per shade of colour used.

Now, the number of shades used in an installation for spraying coating products is tending to increase, which induces an increase in the number of circulating lines and increases the cost of the installation accordingly, while problems of space requirement are raised, particularly at the level of the passages through partitions.

The use of tanks borne on the arm of a multi-axis robot does not necessarily enable this problem to be solved. In effect, in the system known from EP-A-0 274 322, coating product circulatings are provided up to the zone of activity of the robot. In other systems, such as disclosed for example in EP-A-0 796 665, a carrousel is provided for filling cartridges with coating products but circulatings for supplying coating products are provided up to the vicinity of this carrousel for filling the cartridges.

In all cases, the permanent stirring of the coating products in the circulatings leads to a degradation of their physicochemical properties due to the mechanical stresses to which they are subjected, in particular the shear undergone at the level of the changes in direction, the pumps or the pressure regulators.

Another solution known from DE-A-197 04 573 consists in using prefilled cartridges, which are for example disposable, but this leads to complex manipulations of a large number of cartridges, which is not economically satisfactory and renders the system of management of such an installation considerably complex.

It is a particular object of the present invention to overcome these problems by proposing a novel atomizer supply device which does not necessitate the construction of a circulating up to the vicinity of an installation and avoids the manipulation of too large a number of cartridges.

SUMMARY OF THE INVENTION

To that end, the invention relates to a device for supplying coating products to the atomizers of an installation spraying such products onto objects displaced by a conveyor, this device comprising at least one principal tank adapted to supply secondary tanks each intended for an atomizer, and means for displacing this principal tank up to the vicinity of the afore-mentioned secondary tanks.

The principal tank or tanks make it possible to supply different secondary tanks of the installation by being displaced up to said tanks. The principal tanks may be packaged outside the factory in which the installation is employed and, in particular, in the premises of the coating product manufacturer, the principal tanks in that case corresponding to a particular packaging of the product. It then suffices to transport different principal tanks up to the vicinity of the installation then, as a function of the coating product to be sprayed, to displace a principal tank as far as the different secondary tanks in order to supply them with coating products. No degradation of the coating product by shear occurs in the principal tank or tanks. The secondary tanks remain in the installation and it is unnecessary to manage a large number of disposable or refillable cartridges.

According to advantageous aspects of the invention, the device incorporates one or more of the following characteristics:

The or each principal tank is adapted to contain a quantity of coating product sufficient to supply the secondary tanks intended for the sprays of the installation for completely coating an object or one side of an object. In this way, a principal tank may for example enable all the sprays located on one side of the installation to be supplied with an adequate quantity of paint, without waste. In a variant, the quantity of products present in the principal tank corresponds to the complete coating of an object.

The afore-mentioned displacement means comprise at least one conveyor adapted to displace the principal tanks parallel to the direction of advance of a conveyor for displacing the objects.

The means for displacing the principal tanks are constituted by the conveyor displacing the objects to be coated.

According to a first advantageous embodiment of the invention, the principal tanks may be connected to at least one secondary tank borne by a robot and associated with an atomizer.

According to another embodiment of the invention, the device comprises at least one station for temporary storage of at least one secondary tank and means for temporary connection of a principal tank with at least one secondary tank in place in this station. In that case, the secondary tanks may be filled in masked time in the temporary storage station.

The invention also relates to a method which may be carried out with the device described hereinabove, and more specifically to a method which comprises the steps consisting in:

- conducting at least one principal tank containing a coating product up to the vicinity of at least one secondary tank intended for an atomizer;
- transferring coating product from the principal tank towards the secondary tank, and supplying the atomizer with coating products from the secondary tank.

According to a first advantageous embodiment of the invention, the method comprises more particularly the steps consisting in:

- conducting the principal tank up to in the zone of activity of a robot for positioning the atomizer and a secondary tank intended for that atomizer;
- displacing the secondary tank by means of the robot up to the immediate vicinity of the principal tank before transferring the product from the principal tank towards the secondary tank, and after the transfer, displacing the secondary tank towards a position in which the atomizer is able to coat the afore-mentioned objects.

According to another advantageous embodiment of the invention, the method comprises the steps consisting in:

conducting the principal tank up to the vicinity of a station for temporary storage of at least one secondary tank;

transferring product from the principal tank towards at least one secondary tank in place in the station, and mounting at least one secondary tank filled from said principal tank on a paint-applying robot.

In that case, each secondary tank may be provided to form a sub-assembly with an atomizer for which it is intended and such a sub-assembly is provided to be mounted on the robot after filling of the secondary tank in the temporary storage unit.

Whatever the embodiment envisaged, the method advantageously consists in filling the principal tank with a sufficient quantity to coat the same object or one side of the same object by different atomizers and in supplying the atomizers by means of secondary tanks filled by transfer from this principal tank.

Finally, the invention relates to an installation for spraying coating products, comprising a device as described hereinabove, possibly employed with the method as described hereinbefore. The cost price of such an installation is substantially less than the known installations having to be supplied with circulatings and it is much simpler to use than an installation supplied solely with cartridges each intended for an atomizer.

BRIEF DESCRIPTION OF THE DRAWINGS

The invention will be more readily understood on reading the following description of two embodiments of an installation in accordance with its principle, given solely by way of example and made with reference to the accompanying drawings, in which.

DESCRIPTION OF PREFERRED EMBODIMENTS

Figure 1:
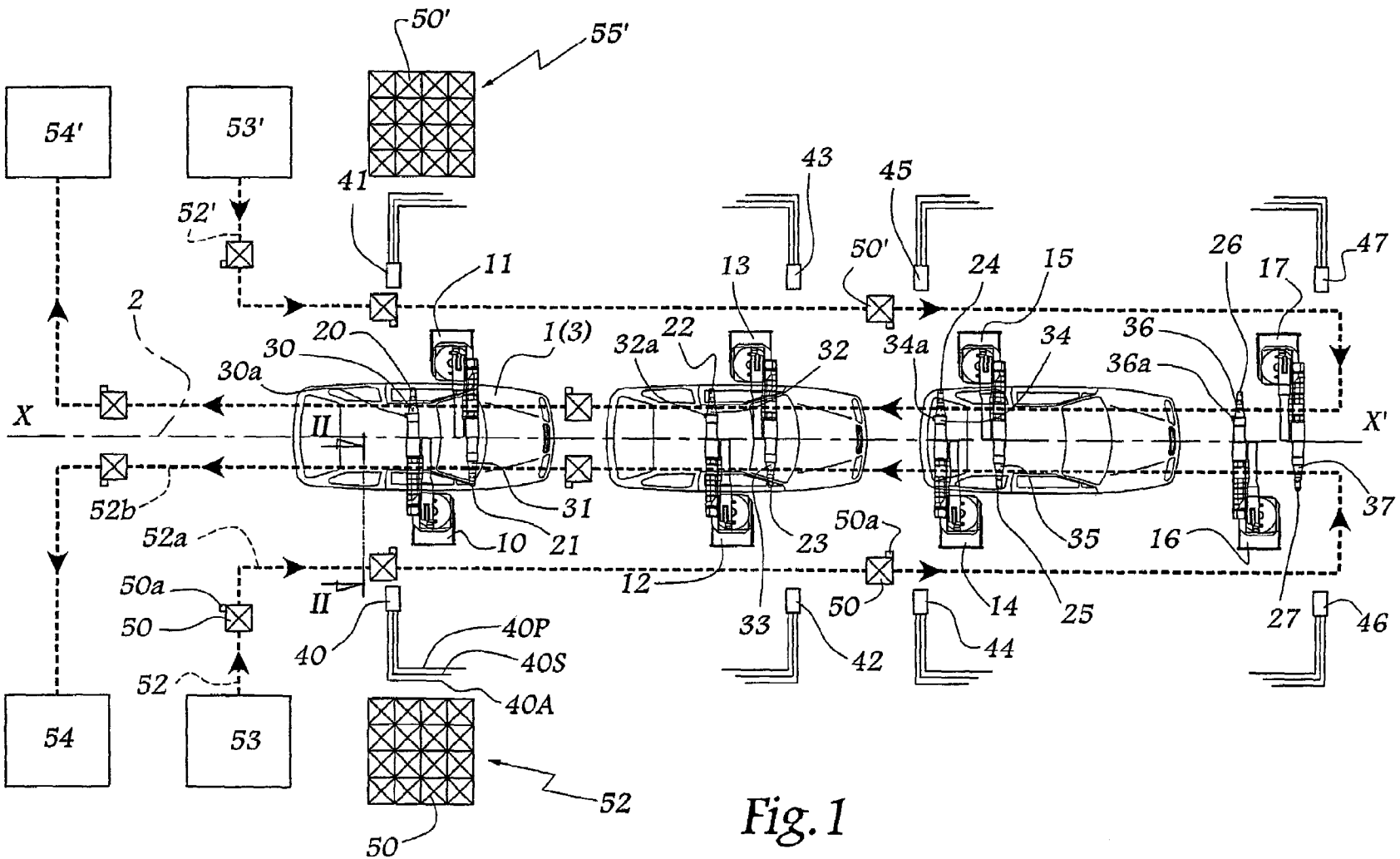
FIG. 1 schematically shows a plan view of an installation according to a first embodiment of the invention, the atomizers all being in the course of application.

Referring now to the drawings, the installation shown in FIG. 1 is provided for coating automobile vehicle bodies 1 with liquid paint, said bodies being displaced by a conveyor 2 in a substantially rectilinear direction X–X'. The bodies 1 are each supported by a carriage or toboggan 3 driven by the conveyor 2.

Multi-axis robots 10 to 17 are distributed on either side of the conveyor 2 and toboggans 3, and are each equipped with an atomizer 20 to 27 and a tank 30 to 37 associated therewith. The tanks 30 to 37 are permanently mounted in the vicinity of the wrist of each robot. The capacity of each tank 30 to 37 is sufficient to allow the desired application of coating products on a body 1.

The robots 10 to 13 may be provided to be intended for the application of a first coating layer inside a body, while the robots 14 to 17 are intended for the application of a second layer inside the bodies. According to a variant of the invention (not shown), the installation may also comprise other robots intended respectively for the application of a first layer and a second layer outside the body, a station for manual retouching possibly being provided in the downstream part of the booth of the installation.

After a body has been coated, each tank 30 to 37 must be cleaned and filled with a fresh coating product, most often different from that used previously, as the automobile vehicles are painted as a function of the customers' orders.

To that end, stations 40 to 47 for cleaning the tanks are provided in the vicinity of each robot 10 to 17. Station 40 is supplied with air via a conduit 40A and with solvent via a conduit 40S, while a drain conduit 40P allows the paint and solvent residues resulting from a cleaning operation to be collected. The other stations are connected in the same manner to their environment.

Figure 2:
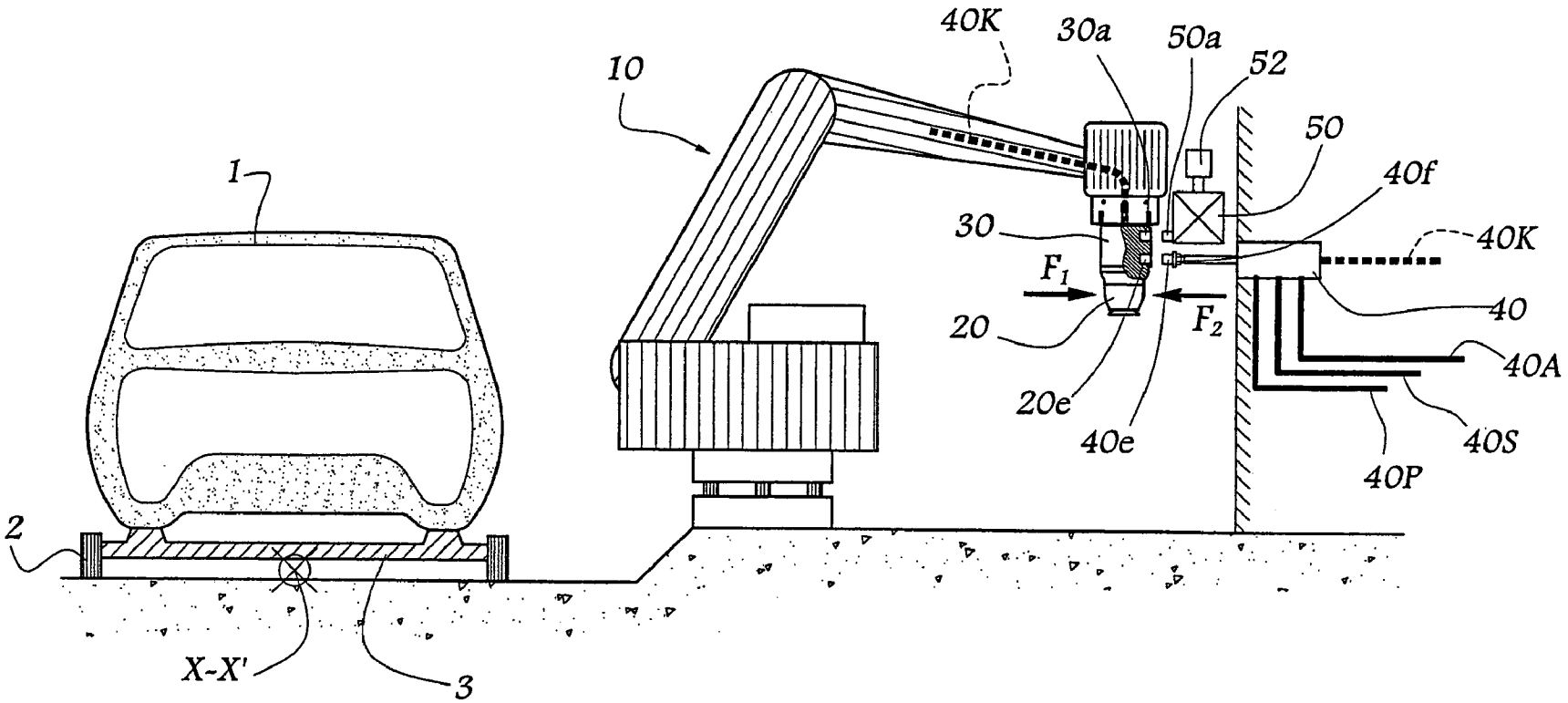
FIG. 2 is a partial section, on a larger scale and along line II—II of FIG. 1, of part of the installation of FIG. 1 in the course of cleaning/filling of a tank of a robot thereof.

After the product contained in the tank 30 has been used, the robot 10 approaches the tank 30 and the atomizer 20 towards the station 40, as represented by arrow $F_1$ in FIG. 2. A plate 40*f* of station 40 is then applied on the atomizer 20, this plate being provided with connection means 40*e* adapted to cooperate with corresponding connection means 20*e* provided on the atomizer 20. Inside the robot 10 there are provided conduits (not shown) connecting the atomizer 20 to the tank 30 and making it possible, via means 20*e*, to supply the tank 30 with air and solvent and to collect the residue thereof.

In this way, the station 40 makes it possible to clean the atomizer 20 and the tank 30 before they are used again.

The same applies for stations 41 to 47 and the other atomizers and tanks.

For filling the tanks 30, 32, 34 and 36, it is provided that principal tanks 50 circulate on a conveyor 52 leaving a loading zone 53 and arriving at an unloading zone 54. The conveyor 52 comprises a branch 52*a* and a branch 52*b* substantially parallel to direction X–X', the circulation taking place in the direction of advance of the conveyor on branch 52*a* and in the opposite direction on branch 52*b*.

Each principal tank 50 has a capacity equal to the sum of the capacities of tanks 30, 32, 34 and 36 and is provided with connection means 50*a* provided to cooperate with connection means 30*a* arranged on or in the vicinity of the tank 30.

Tanks 32, 34 and 36 are likewise provided with such connection means 32*a*, 34*a* and 36*a*.

Functioning is as follows: Depending on the shade provided for a body entering the installation, a tank 50 is selected and disposed, by a manipulator robot (not shown), on the loading zone from which it is conducted by the conveyor 52 up to the robot 10. After the preceding body has been coated, the robot 10 pivots and docks on the cleaning station 40 as indicated hereinabove. The position of the tank 50 is in that case such that the movement $F_1$ of the robot induces a coupling of the means 30*a* and 50*a*, which makes it possible to take from the tank 50 the quantity provided to be stored in the tank 30 and applied by the atomizer 20 on said body.

With the foregoing in mind, cleaning of the atomizer 20 and of the tank 30 and filling of the tank 30 take place thanks to a single movement of the robot 10. In other words, the position of cleaning of the atomizer and of the tank is the same as the position of filling of the tank.

As the robot 10 is docked on the station 40 during filling of the tank 30 from the tank 50, it is possible to supply the tank 50 with air for pressurization from the station 40 and through the robot 10. In this way, the transfer of products from the tank 50 towards the tank 30 may take place under pressure, thus reducing the cycle time.

The air supply 40A of station 40 may also be used for actuating stirring means provided in the tank 50, in order to homogenize the product before it is transferred towards the tank 30.

During this cleaning and filling, the body 1 in question progresses in the direction of the robot 10 and, at the end of the operation of filling of the tank 30, the application with the atomizer 20 may begin.

The conveyor 52 then displaces the principal tank 50 in the direction of the robot 12 at whose level the tank 32 is cleaned and filled like the tank 30 with a view to applying the same product on the same body.

The tank 50 then continues its advance in the direction of robots 14 and 16 with a view to successive cleaning and filling of tanks 34 and 36.

After the last robot, the tank 50 is conducted towards the unloading zone 54 by a return along branch 52*b* of the conveyor 52.

The same applies to the opposite side of the bodies 1 where a conveyor 52' is provided, between a loading zone 53' and an unloading zone 54', for conducting principal tanks 50' up to robots 11, 13, 15 and 17 with a view to filling tanks 31, 33, 35 and 37.

If other robots are provided downstream of robots 16 and 17, the capacity of tanks 50 and 50' is increased. In any case, the tanks 50 and 50' transport a sufficient quantity of paint to completely coat one side of a body 1. In practice, it may be envisaged to fill the tanks 50 and 50' with a quantity slightly greater than that which is theoretically needed, in order to have a reserve available, for example for a manual application.

Where a manual application station is provided, the tanks 50 and 50' are conducted up to this station. The painters' guns are equipped with incorporated tanks which may be filled from the principal tanks. According to an advantageous variant, the hand guns are not equipped with tanks incorporated therein, the guns being directly supplied by the principal tanks 50 and 50' via flexible pipes. In that case, a means for pressurizing the interior volume of the principal tanks may be provided.

Racks 55 and 55' are arranged in the vicinity of the loading zones 53 and 53' for supplying the conveyors 52 and 52' with principal tanks 50 and 50', as a function of the shades selected for the bodies 1. These racks may be prepared outside the paint spray workshop, the distribution of the shades in the different tanks 50 and 50' being predetermined as a function of the envisaged use of the installation.

In the case of coating products composed of two components, the base of the products may be provided to be transported in the principal tanks 50 and 50', while the catalyst, which is identical whatever the base considered, is conducted via a conduit 40K, shown solely in FIG. 2, at the level of station 40. In this way, when the tank 30 is being filled with base from tank 50, a filling of catalyst may take place from station 40.

In a variant, the conduit 40K supplying catalyst may be disposed in the arm of each robot, as represented in dashed-and-dotted lines for the robot 10 in FIG. 2.

In any case, the base and the catalyst are mixed just before the product contained in the tank 30 is used.

Figure 3:
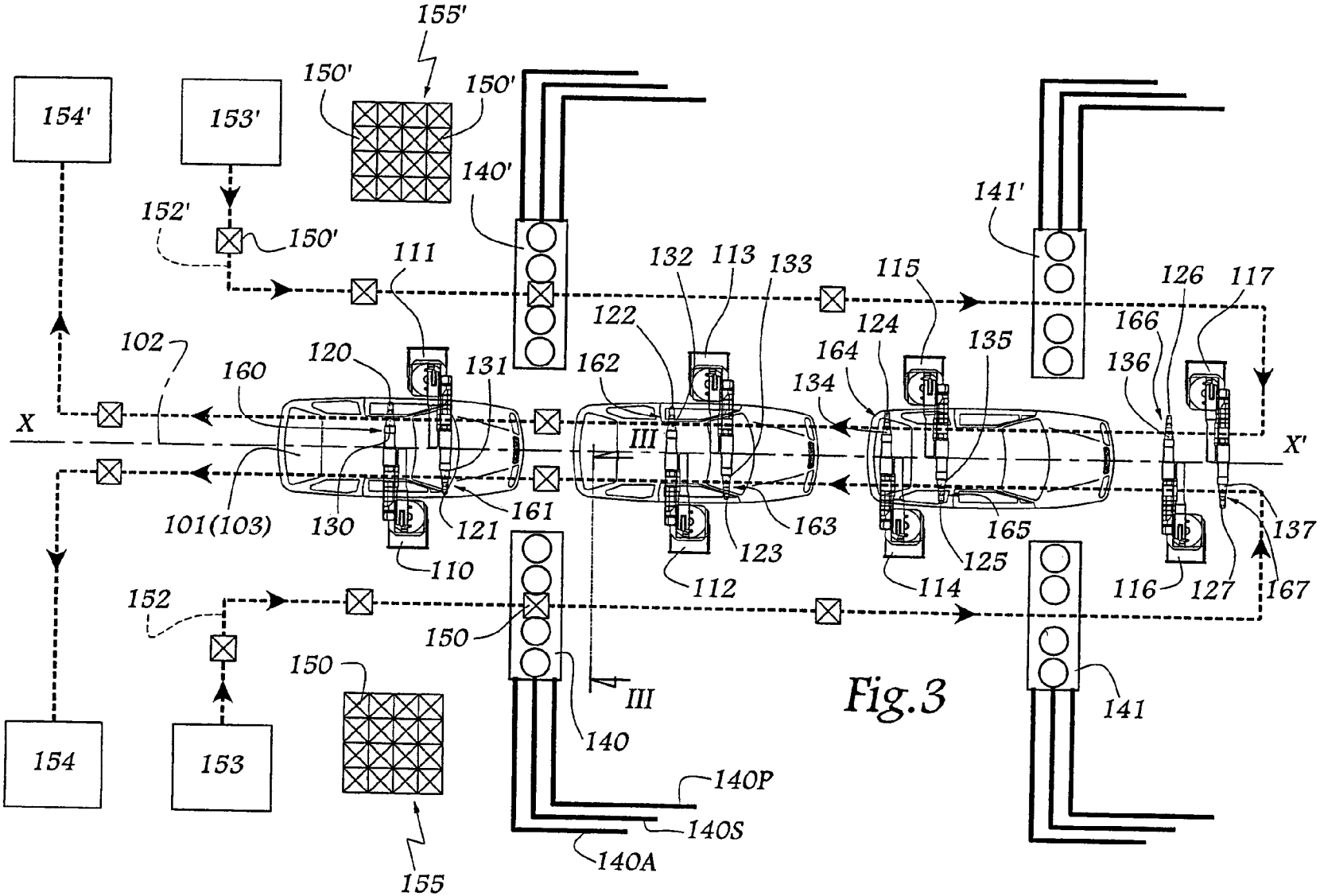
FIG. 3 is a view similar to FIG. 1 for an installation according to a second embodiment of the invention.
Figure 4:
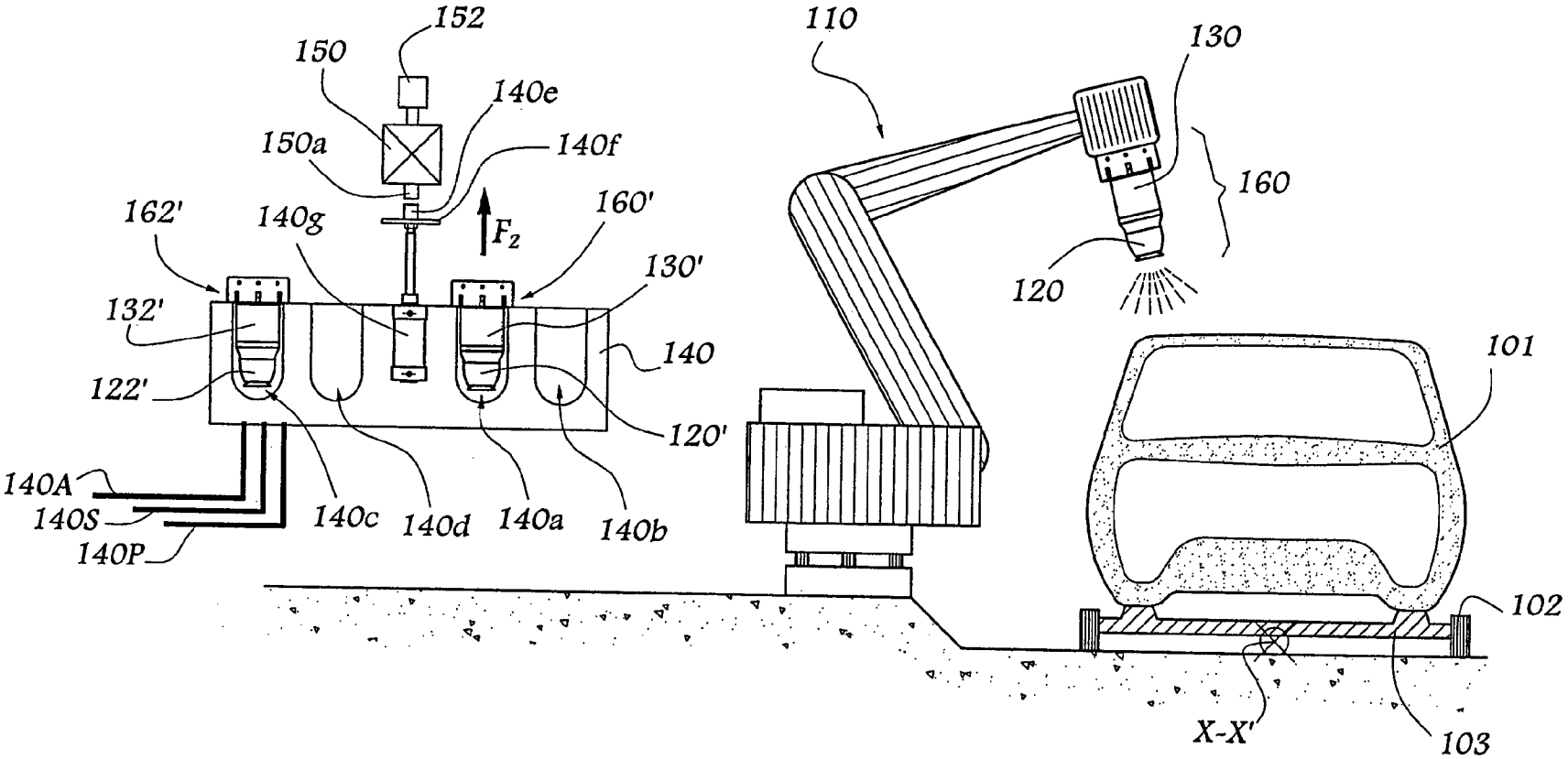
FIG. 4 is a section along line IV—IV of FIG. 3.

In the second embodiment of the invention shown in FIGS. 3 and 4, the elements similar to those of the first embodiment bear identical references, increased by 100. In this embodiment, bodies 101 are conveyed by toboggans 103 displaced by a conveyor 102. Robots 110 to 117 are disposed on either side of this conveyor and are equipped with sub-assemblies 160 to 167 each comprising an atomizer 120 to 127 and a tank 130 to 137, each sub-assembly being removably mounted at the end of the arm of a robot. As previously, the principal tanks 150 and 150' are conducted by conveyors 152 and 152' along the conveyor 102.

Between the robots 110 and 112, there is installed a station 140 for temporarily storing sub-assemblies 160 and equivalent, this station 140 being intended for the preparation of sub-assemblies provided to be mounted on the robots 110 and 112.

As is more particularly visible in FIG. 4, the station 140 defines four housings 140*a*, 140*b*, 140*c* and 140*d* for receiving sub-assemblies 160 and 162. More precisely, housings 140*a* and 140*b* are intended for receiving the sub-assemblies to be mounted on the robot 110, while housings 140*c* and 140*d* are intended for the sub-assemblies to be mounted on the robot 112. The housing 140*a* effectively contains a sub-assembly 160', while housing 140*b* is ready to receive the sub-assembly 160 mounted at the end of the robot 110. In the same way, housing 140*c* contains a sub-assembly 162' intended to be mounted on the robot 112, while housing 140*d* is empty and ready to receive the sub-assembly 162 mounted on the robot 112. The sub-assemblies 160' and 162' respectively comprise atomizers 120' and 122' and tanks 130' and 132' similar to those of sub-assemblies 160 and 162.

The station 140 is equipped with an air supply conduit 140A, a solvent supply conduit 140S and a drain conduit 140*p*.

With the foregoing in mind, it will be understood that the robots 110 and 112 alternately take one of the sub-assemblies 160 or 162 available in the station 140, one sub-assembly being able to be filled while the other subassembly is being used on one of the robots.

Such filling takes place thanks to the tank 150 which is conducted by the conveyor 152 up to the level of the station 140, the tank 150 being provided with a means 150*a* for quick connection with connection means 140*e* borne by a plate 140*f* capable of movements of translation, represented by arrow $F_2$ in FIG. 4, being controlled by a jack 140*g* which may be hydraulic, pneumatic or electric.

The connection means 140*e* are connected by flexible pipes (not shown) to the sub-assemblies 160 and 162 present in the housings 140*a* to 140*d*.

It is possible to fill the tanks 130 and 132 of the sub-assemblies 160 and 162 when they are in place in the station 140 and before the robots 110 and 112 take over these sub-assemblies with a view to spraying the coating products on the bodies 101.

The tank 150 may be supplied with air for pressurization or with air for actuating a stirrer from the conduit 140A of the station 140 when the plate 140*f* is in contact with the tanks 150, in which case appropriate connecting means are provided.

Another station 141, similar to station 140, is provided between the robots 114 and 116 for preparing the sub-assemblies 164 and 166, and particularly for cleaning the atomizers 124 and 126 and cleaning/filling the tanks 134 and 136. Tank 150 is conducted towards station 141 after its connection to station 140.

On the opposite side of the conveyor 102 there are provided two stations 140' and 141' for temporary storage and cleaning/filling of the sub-assemblies 161, 163, 165 and 167. Principal tanks 150' are conducted by a conveyor 152' up to the vicinity of the stations 140' and 141' for filling the tanks 131, 133, 135 and 137.

As previously, loading zones 153 and 153' and zones 154 and 154' for unloading the conveyors 152 and 152' are provided, racks 155 and 155' allowing temporary storage of the tanks 150 and 150', full or empty, in the vicinity of zones 153, 153', 154 and 154'.

Manipulation of the principal tanks 50, 50', 150 and 150' between the racks and the loading/unloading zones may be effected by a manipulator robot or by an operator.

The second embodiment of the invention presents the particular advantage that the secondary tanks 130 to 137 are filled in masked time with respect to the spraying, this consequently allowing the cycle time to be reduced.

According to an advantageous aspect of the invention, the stations 140, 140', 141 and 141' are provided inside a spraying booth, while conveyors 152 and 152' are arranged outside this booth, for example at a different level. In that case, the tanks 130 to 137 are filled via a passage through the partition of this booth. According to a variant, the stations 140, 140', 141 and 141' may be arranged outside the booth where they are supplied with coating products, these stations being at least partly mobile in order to conduct the sub-assemblies 120 to 127 inside the booth by traversing a partition thereof, in order that the robots 110 to 117 can access the housings 140*a* to 140*d* and equivalent.

According to a variant of the invention (not shown), a station for temporary tank storage may be associated with each robot 110 to 117, each station comprising two housings for receiving two sub-assemblies mounted alternately on each robot. The embodiment represents the grouping of the stations for two robots, with four locations for receiving sub-assemblies, allowing a saving of space and a more attractive cost price. Whatever the embodiment considered, means for monitoring the temperature of the product in the principal tanks may be provided, such means being able to be activated permanently or just before the transfer towards the secondary tanks. Similarly, stirring means may be activated permanently or just before transfer.

According to a variant of the invention (not shown), applicable to the two embodiments described, the conveyors for displacing the principal tanks may be constituted by the conveyor 2 or 102, insofar as the principal tanks may be supported by the toboggans 3 or 103, the movement of connection of the robots or the parts of the temporary storage stations being adapted accordingly.

The invention has been described with an installation for spraying liquid coating products. It is applicable to the spraying of all types of liquid products containing solvents, hydrosoluble or composed of two components, and to the spraying of pulverulent coating products.

The invention has been represented in the case of an installation for coating automobile vehicle bodies. However, it is applicable to the coating of all types of objects, particularly spare parts, by means of atomizers of all types, electrostatic or not, rotary or pneumatic.

The invention has been represented with multi-axis robots. It is applicable with any type of robot adapted to displace at least one atomizer opposite objects to be coated, in particular with machines of "reciprocator" type or of the type known from EP 0 720 515. The invention might also be carried out in an installation comprising a succession of manual coating stations.

In the case of an existing installation already comprising circulatings or in the case of an installation provided for the spraying of so-called "current" products and so-called "rare" products used less often, circulatings may be employed for supplying the atomizers with the products most often employed, while the device with principal tanks is used for the products used least often.

Whatever the variant considered, one or more atomizers mounted on a robot or a machine may be supplied from the same secondary tank.

According to a variant of the invention (not shown), the zones 53 and 54 for loading/unloading the principal tanks may be provided at two opposite ends of the booth, which avoids having to resort to a loop conveyor 52. This is also applicable to the second embodiment.

What is claimed is:

1. Method for supplying coating products to at least one atomizer of an installation for spraying coating products, comprising the steps of: displacing at least one principal tank containing a coating product up to the vicinity of at least one secondary tank intended for an atomizer, said step of displacing being carried out by conducting said principal tank up to in the zone of activity of a robot for positioning said atomizer and a secondary tank intended for said atomizer; displacing said secondary tank by means of said robot up to the immediate vicinity of said principal tank before transferring said product from said principal tank towards said secondary tank; transferring coating product from said principal tank towards said secondary tank after said displacing step; after said step of transferring, displacing said secondary tank towards a position in which said atomizer is able to spray said product; and supplying said atomizer with coating products from said secondary tank.

2. The method of claim 1, wherein it comprises filling said principal tank with a sufficient quantity for coating the same object or one side of the same object by different atomizers, and supplying said atomizers by means of secondary tanks filled by transfer from said principal tank.

3. The method of claim 1, wherein said step of displacing at least one principal tank comprises mounting said at least one principal tank on a conveying device and operating the conveying device to bring the at least one principal tank to the vicinity of the at least one secondary tank.

4. Method for supplying coating products to at least one atomizer of an installation for spraying coating products, comprising the steps of: displacing at least one principal tank containing a coating product up to the vicinity of at least one secondary tank intended for an atomizer, by conducting said principal tank up to the vicinity of a station for temporary storage of the at least one secondary tank; transferring product from said principal tank towards said at least one secondary tank in place in said station; transferring coating product from said principal tank towards said secondary tank after said displacing step; mounting said at least one secondary tank filled from said principal tank on a paint-applying robot; and supplying said atomizer with coating products from said secondary tank.

5. The method of claim 4, wherein each secondary tank forms a sub-assembly with an atomizer for which it is intended, and in that such a sub-assembly is mounted on said robot after filling of said secondary tank in said temporary storage unit.

6. The method of claim 4, wherein it comprises filling said principal tank with a sufficient quantity for coating the same object or one side of the same object by different atomizers, and supplying said atomizers by means of secondary tanks filled by transfer from said principal tank.

* * * * *